US009482077B2

(12) United States Patent
Yeriazarian et al.

(10) Patent No.: US 9,482,077 B2
(45) Date of Patent: Nov. 1, 2016

(54) METHOD FOR CONTROLLING FLUID PRODUCTION FROM A WELLBORE BY USING A SCRIPT

(75) Inventors: Garabed Yeriazarian, Houston, TX (US); Chee M. Chok, Houston, TX (US)

(73) Assignee: BAKER HUGHES INCORPORATED, Houston, TX (US)

( * ) Notice: Subject to any disclaimer, the term of this patent is extended or adjusted under 35 U.S.C. 154(b) by 1069 days.

(21) Appl. No.: 12/564,742

(22) Filed: Sep. 22, 2009

(65) Prior Publication Data

US 2011/0071810 A1 Mar. 24, 2011

(51) Int. Cl.

| | |
|---|---|
| ***G06G 7/66*** | (2006.01) |
| ***G06G 7/57*** | (2006.01) |
| ***G05D 7/06*** | (2006.01) |
| ***E21B 43/12*** | (2006.01) |

(52) U.S. Cl.

CPC ..... *E21B 43/12* (2013.01)

(58) Field of Classification Search

CPC ..... E21B 47/00; G06T 13/00; G06T 19/00; G06T 15/20; G06T 2219/004

See application file for complete search history.

(56) References Cited

U.S. PATENT DOCUMENTS

| | | | | |
|---|---|---|---|---|
| 3,999,607 | A * | 12/1976 | Pennington et al. | 166/259 |
| 5,390,741 | A * | 2/1995 | Payton et al. | 166/284 |
| 5,975,204 | A | 11/1999 | Tubel et al. | |
| 5,992,519 | A | 11/1999 | Ramakrishnan et al. | |
| 6,012,015 | A | 1/2000 | Tubel | |
| 6,176,323 | B1 * | 1/2001 | Weirich et al. | 175/40 |
| 6,282,452 | B1 | 8/2001 | DeGuzman et al. | |
| 6,434,435 | B1 * | 8/2002 | Tubel et al. | 700/30 |
| 6,715,551 | B2 | 4/2004 | Curtis et al. | |
| 6,968,909 | B2 * | 11/2005 | Aldred et al. | 175/26 |
| 6,980,940 | B1 | 12/2005 | Gurpinar et al. | |
| 8,199,166 | B2 * | 6/2012 | Repin et al. | 345/633 |
| 2005/0222772 | A1 * | 10/2005 | Koederitz et al. | 702/6 |
| 2005/0279532 | A1 * | 12/2005 | Ballantyne et al. | 175/40 |
| 2007/0007003 | A1 * | 1/2007 | Jackson et al. | 166/244.1 |
| 2007/0060320 | A1 * | 3/2007 | Kelly | G07F 17/32 463/27 |
| 2007/0175633 | A1 | 8/2007 | Kosmala et al. | |
| 2008/0308270 | A1 * | 12/2008 | Wilson | 166/244.1 |

(Continued)

FOREIGN PATENT DOCUMENTS

| | | | |
|---|---|---|---|
| GB | 2376704 | A | 12/2002 |
| WO | 0123705 | A1 | 4/2001 |
| WO | WO02063130 | A1 | 8/2002 |

OTHER PUBLICATIONS

International Search Report mailed May 9, 2011, International Application No. PCT/US2010/049670.

Written Opinion of the International Searching Authority mailed May 9, 2011; International Application No. PCT/US2010/049670.

European Search Report; Application No. EP 10 81 9337, dated Feb. 28, 2014, pp. 1-9.

(Continued)

*Primary Examiner* — Sean Shechtman

(74) *Attorney, Agent, or Firm* — Cantor Colburn LLP

(57) ABSTRACT

In one aspect, a method is provided for controlling fluid flow in a wellbore containing a plurality of production devices, wherein the method includes the steps of defining a first setting of each production device in the plurality of production devices, defining a change in a parameter relating to fluid flow in the wellbore and using a model to determine a second setting for at least one of the plurality of production devices based on the change in the parameter. The method also includes the step of generating a script corresponding to the second setting, wherein the script is configured to be implemented without modification, and storing the script in a suitable storage medium.

20 Claims, 8 Drawing Sheets

(56) References Cited

U.S. PATENT DOCUMENTS

2009/0095484 A1 4/2009 Huang et al.
2009/0229819 A1* 9/2009 Repin et al. ..... 166/250.01
2010/0191516 A1 7/2010 Benish et al.

* cited by examiner

METHOD FOR CONTROLLING FLUID PRODUCTION FROM A WELLBORE BY USING A SCRIPT

BACKGROUND OF THE DISCLOSURE

1. Field of the Disclosure

This disclosure relates generally to well design, modeling well performance and well monitoring.

2. Background of the Art

Wellbores are drilled in subsurface formations for the production of hydrocarbons (oil and gas). Some such wells are vertical or near vertical wells that penetrate more than one reservoir or production zone. Inclined and horizontal wells are also now common, wherein the well traverses the production zone (or reservoir) substantially horizontally, i.e., substantially along the length of the reservoir. Many wells produce hydrocarbons from multiple production zones. In flow control valves are installed in the well to control the flow of the fluid from each production zone. In such multi-zone wells (production wells or injection wells) fluid from different production zones is comingled at one or more points in the well fluid flow path. The comingled fluid flows to the surface wellhead via a tubing. The flow of the fluids to the surface depends upon: properties or characteristics of the formation (such as permeability, formation pressure and temperature, etc.); fluid flow path configurations and equipment therein (such as tubing size, annulus used for flowing the fluid, gravel pack, chokes and valves, temperature and pressure profiles in the wellbore, etc.). It is desirable to monitor production parameters and control production from each zone and through the various devices in the well to maintain the production at desired levels and to shut down or reduce flow from selected zones when an adverse condition, such as water breakthrough, occurs in the well. The disclosure herein provides an improved method and system for monitoring and controlling production from wellbores.

SUMMARY OF THE DISCLOSURE

In one aspect, a method is provided for controlling fluid flow in a wellbore containing a plurality of production devices, wherein the method includes the steps of defining a first setting of each production device in the plurality of production devices, defining a change in a parameter relating to fluid flow in the wellbore and using a model to determine a second setting for at least one of the plurality of production devices based on the change in the parameter. The method also includes the step of generating a script corresponding to the second setting, wherein the script is configured to be implemented without modification, and storing the script in a suitable storage medium.

In one aspect, a method for controlling wellbore devices is provided that includes receiving a desired value for at least one production parameter at a selected location along a length of a wellbore, wherein the operator inputs the desired value via a graphical element. The method also includes the steps of processing the desired value to determine a setting of at least one production device which will provide the desired value when implemented and creating a script file corresponding to the setting, wherein the script is configured to be implemented without modification.

Examples of the more important features of the apparatus and method have been summarized rather broadly in order that the detailed description thereof that follows may be better understood, and in order that the contributions to the art may be appreciated. There are, of course, additional features that will be described hereinafter and which will form the subject of the claims.

BRIEF DESCRIPTION OF THE DRAWINGS

For a detailed understanding of the system and methods for monitoring and controlling production wells described and claimed herein, reference should be made to the accompanying drawings and the following detailed description of the drawings wherein like elements generally have been given like numerals, and wherein:

DETAILED DESCRIPTION OF THE DRAWINGS

Figure 1:
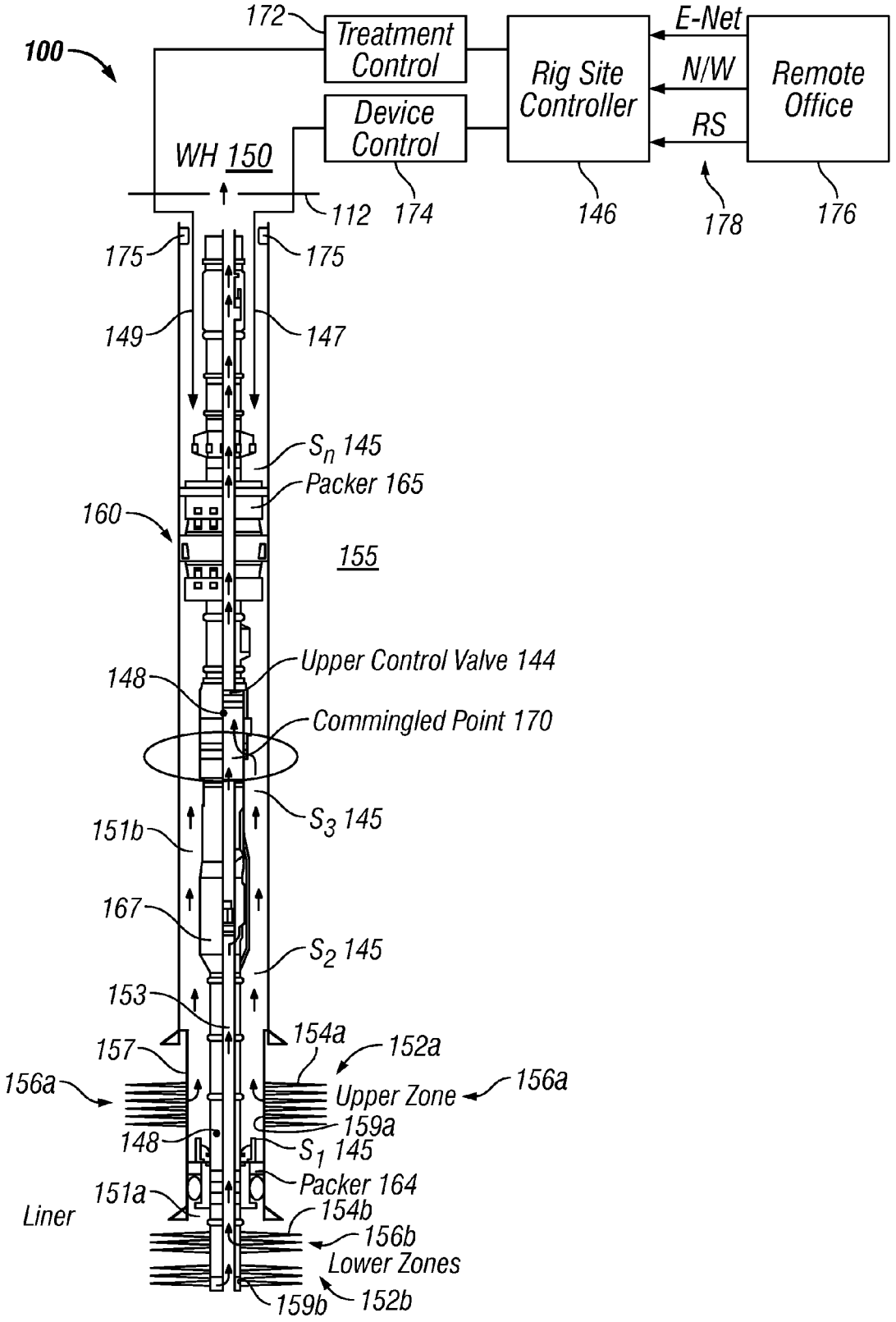
FIG. 1 is a schematic diagram of an exemplary multi-zone production well system configured to monitor and control production of fluid from the wellbore, according to one embodiment.

FIG. 1 is a schematic diagram of an exemplary multi-zone production wellbore system 100. The system 100 is shown to include a wellbore 160 drilled in a formation 155 that produces formation fluid 156*a* and 156*b* from exemplary production zones 152*a* (upper production zone or reservoir) and 152*b* (lower production zone or reservoir) respectively. The wellbore 160 is shown lined with a casing 157 containing perforations 154*a* adjacent the upper production zone 152*a* and perforations 154*b* adjacent the lower production zone 152*b*. A packer 164, which may be a retrievable packer, positioned above or uphole of the lower production zone perforations 154*a* isolates fluid flowing from the lower production zone 152*b* from the fluid flowing from the upper production zone 152*a*. A sand screen 159*b* adjacent the perforations 154*b* may be installed to prevent or inhibit solids, such as sand, from entering into the wellbore 160 from the lower production zone 154*b*. Similarly, a sand screen 159*a* may be used adjacent the upper production zone perforations 159*a* to prevent or inhibit solids from entering into the well 150 from the upper production zone 152*a*.

The formation fluid 156*b* from the lower production zone 152*b* enters the annulus 151*a* of the wellbore 160 through the perforations 154*b* and into a tubing 153 via a flow control device 167. The flow control device 167 (or flow device) may be a remotely-controlled sliding sleeve valve or any other suitable valve or choke configured to regulate the flow of the fluid from the annulus 151*a* into the production tubing 153. The formation fluid 156*a* from the upper production zone 152*a* enters the annulus 151*b* (the annulus above the packer 164) via perforations 154*a*. The formation fluid 156*a* enters into the tubing 153 at a location 170, referred to herein as the comingle point. The fluids 156*a* and 156*b* comingle at the comingle point. An adjustable fluid flow control device 144 (upper control valve) associated with the tubing 153 above the comingle point 170 may be used to regulate the fluid flow from the comingle point 170 to a wellhead 150. A packer 165 above the comingle point 170 prevents the fluid in the annulus 151*b* from flowing to the surface. The wellhead 150 at the surface controls the pressure of the outgoing fluid at a desired level. Various sensors 145 may be deployed in the system 100 for providing information about a number of downhole parameters of interest.

In addition, a well site control unit 146 may be utilized to control fluid flow and log data acquired from sensors 145 within the wellbore 160 and sensors 175 at the surface. For example, the well site control unit 146 may include one or more processors, programs and software to acquire and log production parameters data and also to control the state of flow devices, such as upper control valve 144 and flow control device 167. The well site control unit 146 may also include memory, an operating system, and other hardware and software configured to execute instructions contained in the program(s) to monitor and control various devices of the system 100. The well site control unit 146 may be located at the surface or a remote location and may be configured to control treatment control unit 172 for injecting additives or chemicals in the well 160 at selected location and a device control unit 174 to set the devices in the well at desired settings. The device control unit 174 may communicate with and control the flow control devices downhole, including sensors, valves, sliding sleeves, and chokes. The device control unit 174 may use wireless, wired, or other signals to communicate with and control the plurality of downhole devices, as shown by line 147. In an aspect, the treatment control unit 172 may include a storage tank for housing treatment chemicals as well as various fluid control and communication lines. In an aspect, a variety of fluid (149) communication lines are run in the wellbore to injected fluids into the wellbore. Also, a variety of electrical and data (147) communication lines are run inside the wellbore 160 to control the various devices in the well system 100 and to obtain measurements and other data from the various sensors in the wellbore 160. As an example, the fluid communication line 149 may supply a selected chemical from the treatment control equipment 172 that is injected into the upper production zone 156*a* to improve production fluid flow from the formation 155. Similarly, the data communication line 147 may operate flow devices while controlling and receiving data from wellbore sensors. In addition, the data communication line 147 may provide electrical power to certain devices downhole from a suitable surface power source.

As will be discussed in detail below, in an aspect, the well site control unit 146 is configured to enable an operator to graphically observe the current conditions of the well system 100 based on the sensor measure measurements and/or information received from a remote unit 176. The remote unit 176 may include a controller and programs that enable an operator to communicate, control and monitor information via links 178 to the well site controller 146. The communication links 178 may utilize any suitable reliable and robust data transmission technique, such as radio frequency (RF) signal communication, networks (the internet, cell phone, wi-fi, etc.) or cabled communication (Ethernet, serial links, etc.). In general, controllers, such as well site controller 146 and remote controller 176, may include one or more processors, suitable memory devices, programs, and associated circuitry that are configured to perform various functions and methods described herein. Although only two flow control devices are shown in FIG. 1, the wellbore system may include multiple flow control and other devices along the length of the well 160 as discussed below in reference to FIG. 2.

As discussed in more detail below, the well site controller 146 enables the operator to manipulate the displayed information and data to adjust the levels of one or more parameters to a desired level, resulting in a set of instructions to achieve the desired result (value or level). In one aspect, the user interface enables an operator to implement a system change using an input in a graphical form. In other embodiments, system changes may be may be made using a relatively complex procedure that includes managing numerous devices, settings, inputs, and the corresponding sequence of events within a wellbore fluid production system.

Figure 2:
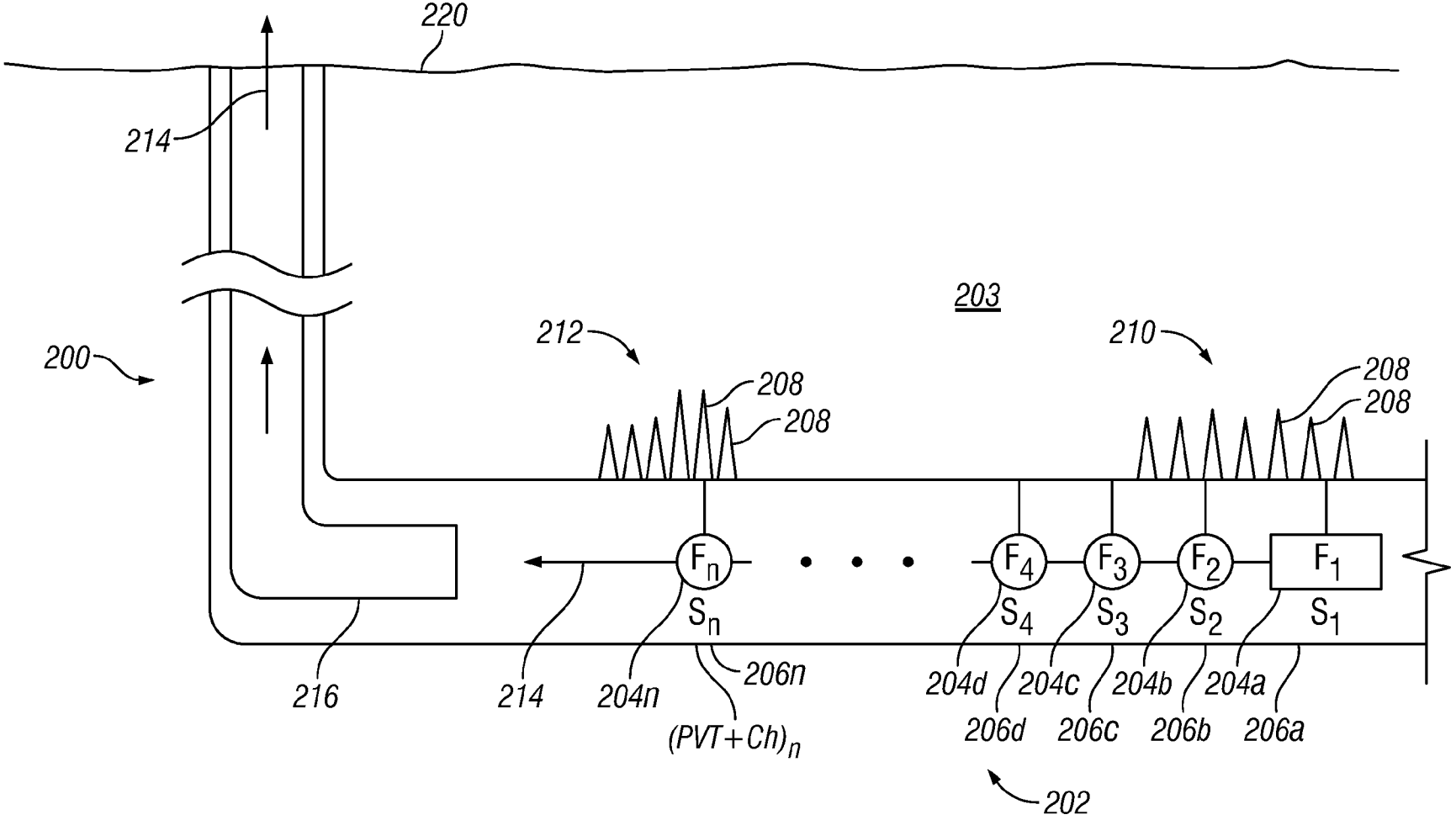
FIG. 2 is a schematic diagram showing exemplary equipment used to produce fluid from the wellbore, according to one embodiment.

FIG. 2 is a schematic diagram of a well system 200 including a well 202 configured to control and monitor production of fluid from a formation 203. The well 202 includes flow devices 204*a-n*, which may be placed at various locations (or depths) within the well 202 to control flow of formation fluid at each location. The flow devices 204*a-n* may each have an associated sensor 206*a-n*,which are configured to measure parameters at each position. As discussed herein, the system 200 includes a plurality of flow devices (204) and sensors (206), wherein the total number of devices is represented by "n" and each device/sensor is denoted by the associated letter in the diagram (a, b, c, etc.) As depicted, each associated letter in the diagram may correspond to a position within the well 202. Further, each flow device 204*a-n* may include one or more mechanisms to control and/or effect fluid flow, such as a choke or valve. The flow devices 204*a-n* may also include systems to provide chemical treatment and/or injections to locations within the well 202, to improve fluid flow and extraction. Similarly, each sensor 206*a-n* may include one or more sensors to monitor one or more parameters, including, but not limited to, flow rate, pressure, temperature, water cut, fluid composition (oil, gas and water) porosity, permeability, resistivity, and skin factor. FIG. 2 is an exemplary schematic representation of a certain number of devices and sensors in the well, however, actual applications may include a large number of devices and sensors located throughout the well 202. For example, a system with a wellbore that is over 6000 feet deep may include several thousand flow devices and sensors.

As depicted in FIG. 2, the formation 203 may include one or more perforations 208, which produce formation fluid within the well 202. A plurality of perforations 208 are located in a first production zone 210 and a second production zone 212. Each of the production zones 210 and 212 may have one or more flow devices 204*a-n* positioned near the production zones to control a flow of formation fluid from the perforations 208 into the wellbore 200. In addition, one or more sensors 206*a-n* may also be positioned to monitor parameters within the production zones 210 and 212. As discussed below with reference to FIGS. 3-5, the system 200 may interface with a controller, such as well site controller 146 to enable an operator to monitor and control a production fluid flow 214 in the well 202.

As illustrated in FIG. 2, the fluid flow 214 may be a combination of fluid flows from the plurality of flow devices 204*a-n* and production zones (210, 212) in the wellbore, wherein each flow device is controlled to produce the desired fluid flow 214 output. A production tubular 216 routes the production fluid flow 214 to a wellhead (not shown) for analysis and treatment. In an aspect, the production fluid is analyzed (e.g. for composition, temperature, flow rates, etc.) at the surface to provide an operator and/or program with more information about the production fluid downhole.

In general, sufficient devices and sensors may be suitably placed in the well 202 to obtain measurements relating to each desired parameter of interest. Such sensors may include, but are not limited to, sensors for measuring pressures corresponding to each production zone, pressure along the wellbore, pressure inside the tubing carrying the formation fluid, pressure in the annulus, temperatures at selected places along the wellbore, fluid flow rates corresponding to each of the production zones, total flow rate, flow through an electric submersible pump (ESP), ESP temperature and pressure, chemical sensors, acoustic or seismic sensors, optical sensors, etc. The sensors may be of any suitable type, including electrical sensors, mechanical sensors, piezoelectric sensors, fiber optic sensors, optical sensors, etc. The signals from the downhole sensors may be partially or fully processed downhole (such as by a microprocessor and associated electronic circuitry that is in signal or data communication with the downhole sensors and devices) and communicated to the surface controller via a signal/data link. The signals from downhole sensors may be sent directly to the controller as described in more detail herein.

Figure 3:
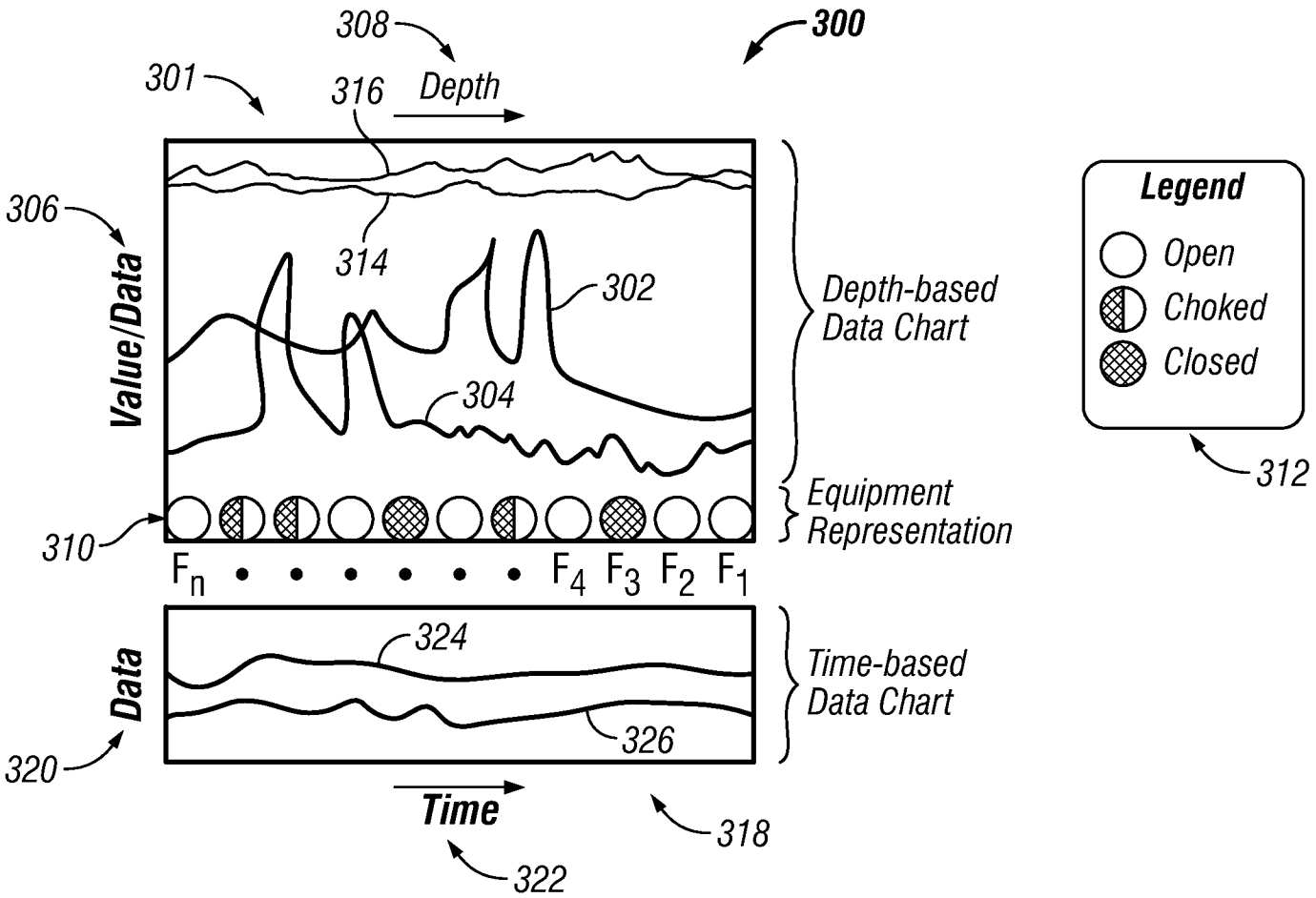
FIG. 3 is a diagram of a user interface of a program to monitor and control fluid production in a wellbore, according to one embodiment.

FIG. 3 is an illustration of a user interface 300 that displays information relating to the extraction and flow of production fluid from the wellbore. In one aspect, the user interface 300 may be a computer display and associated program which acquires and presents the system status/control information, production parameters, formation parameters, and other system information. As depicted, the user interface 300 includes an upper chart 301 that includes data plots of measured parameters, such as flow rate 302 and pressure 304. In chart 301 measured values and data are shown along the y-axis 306 and the depth along the x-axis 308, where the data is plotted against the effective depth or location within the wellbore at a selected time. In an aspect, the data measured by the downhole sensors (as previously discussed with reference to FIG. 2) is positioned at various locations in the wellbore to measure production and formation parameters.

The upper chart 301 also includes a status indicator 310, which shows graphical representation of the status or setting of each device in the well corresponding to its depth along the x-axis 308. A legend 312 may also be included to define each of the status indicator 310 symbols. For example, the status indicator 310 may show the status of each of the flow control devices (204 in FIG. 2) at various positions within the wellbore. As depicted, the status indicator 310 graphically shows that the $F_2$ flow device is open while the $F_3$ flow device is closed and the $F_5$ flow device is partially open. Referencing the x-axis 308, as well as FIG. 2, the $F_2$ flow device is located at a greater depth than the $F_3$ flow device. Moreover, the upper chart 301 displays the measured parameters (302, 304) that correspond to the location (depth 308) and status (310) of each flow device. The upper chart 301 also includes data for formation parameters, such as permeability 314 and porosity 316, which are also plotted against depth of the well. As discussed below with reference to FIGS. 4 and 5, the user interface 300 may enable an operator to graphically input desired values for one or more parameters so that the system computers and programs automatically generate new settings for the downhole devices that, when implemented, will or likely will provide the desired result.

The user interface 300 also is shown to include a lower chart 318, which may show additional parameters and information pertaining to the well and production fluid. As depicted, the lower chart 318 plots measured data 320 (y-axis) over time 322 (x-axis). The chart 318 includes flow rate 324 and permeability 326 plotted over time, where the data is taken at a selected position (e.g. $S_3$) within the well and logged over time.

Figure 4:
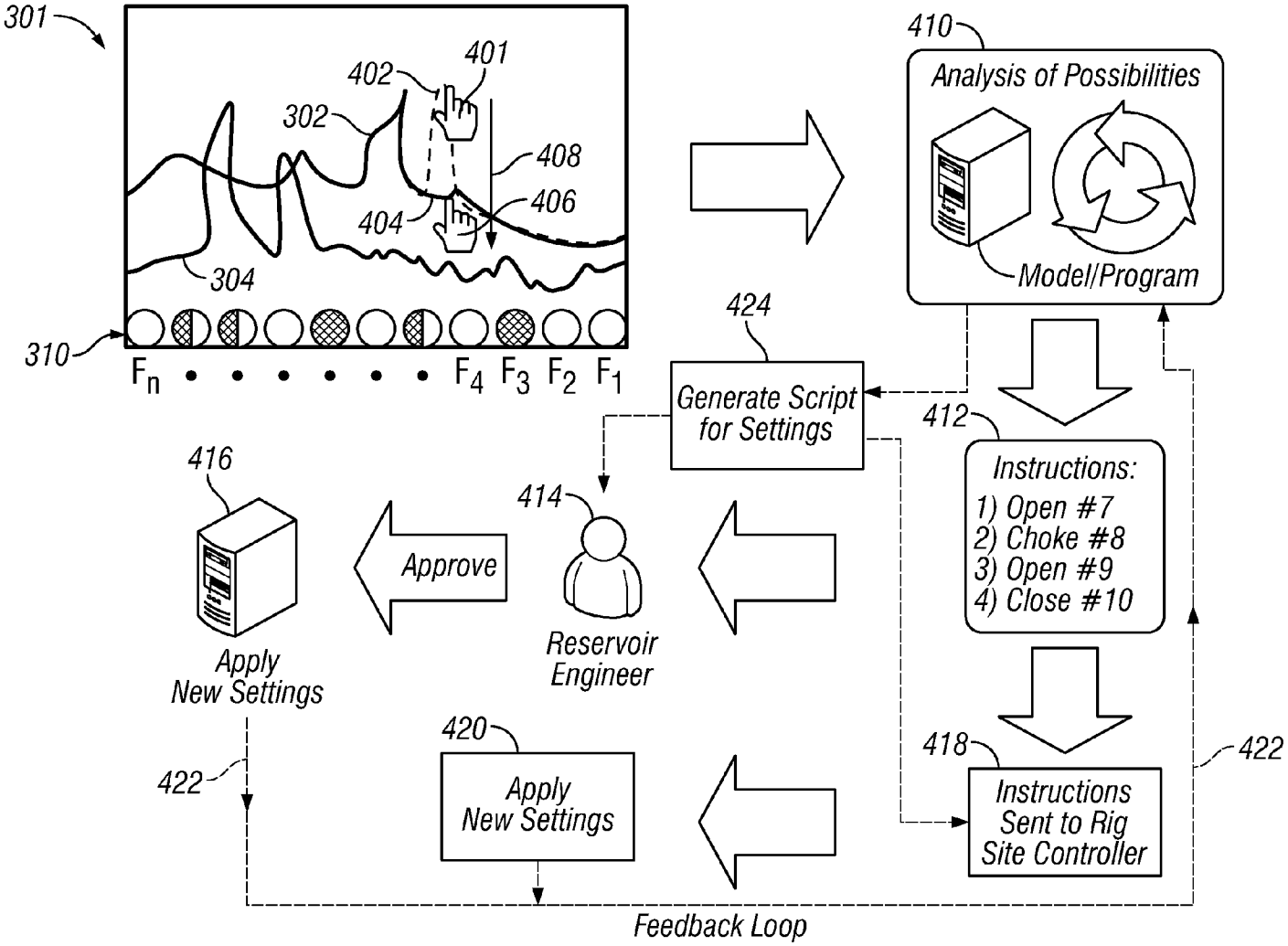
FIG. 4 is a flow chart showing a process and system for monitoring and controlling fluid production in a wellbore, according to one embodiment.

FIG. 4 is a functional diagram of a process and system 400 for monitoring and controlling the flow of production fluid from a well. The system 400 includes the upper chart (or display) 301 of the user interface (300, FIG. 3) which has a control cursor 401 that is configured to enable an operator to graphically manipulate the plots of data. In an embodiment, the control cursor 401 may be used to set a flow rate 302 by dragging an existing plot line 402 to a desired value 404 for the flow rate. The desired value 404 is graphically input by moving or dragging (408) the control cursor 401 to a second location 406, thereby indicating the desired flow rate (404) at that well depth. The control cursor 401 may be any suitable computer pointing device, which may be controlled by any suitable method, including, but not limited to, a keyboard, mouse and a touch screen monitor. As shown, the control cursor 401 may drag 408 a data plot 402, based on the operator's movement of the pointing device. As described herein, a graphical element is one that may use diagrams, graphs, mathematical curves, visual representations, displays or the like to input and/or illustrate information.

The user interface 300 (FIG. 3) may transmit or communicate the desired value 404 to an analysis unit 410 that may include a computer or processor 409 that has access to a simulation software 411 that includes programs, algorithms and data relating to the well, current settings of devices, sensor measurements, historical data, well parameters, etc. (collectively denoted by numeral 410). The computer 409 analyzes and processes the inputs from the operator (e.g. graphically input desired settings) utilizing the information and simulation software 411 to determine the wellbore equipment settings and conditions, which settings when implemented are likely to attain or provide the desired results for the value 404 and other flow rates as shown by curves 302 and 404. The simulation software 411 may utilize a mathematical model, algorithms, simulation methods (iterative, non-iterative, curve fitting techniques) to determine the instructions and settings, that when implemented, will or likely will provide the desired value (or result) 404. For example, the simulation software 411 may process a plurality of inputs, including measured, calculated, operator, and controlled inputs (e.g. equipment status/settings), to calculate the changes needed for the downhole equipment to attain the desired value 404. Further, the software model of the system 400 may be continuously refined and updated by utilizing logged data and other system information. In an aspect, the software model utilizes one of: a simulation; an iterative process; a nodal analysis to determine settings for the system 400.

As shown in FIG. 4, the computer 409 utilizing the simulation software 411, may generate one or more settings and/or instructions 412 to attain the desired value 404. As an example, the instructions 412 provided by the computer may include commands: "1) Open flow device #7; 2) Choke device #8; 3) open device #9; and 4) close device #10 and further the actual setting values for each such device. In another example, the instructions 412 could include commands and settings including choking flow devices $F_2$ and $F_4$ to achieve the desired value 404 for flow rate. Further, the simulation software 411 may also determine that injecting an additive (chemical or another material) at $F_3$ location will aid in attaining the desired value 404. In one aspect, the desired value 404 may not be possible to attain. For example, a user may input a desired value 404 that cannot be produced with the equipment in the system and the current system parameters. Accordingly, the program may instruct the user why the desired value 404 is impossible to attain and provide the user with instructions and a predicted output that is as close as possible to the desired value 404. In some cases, the instructions 412 may be a sequence of commands and settings that may include a relatively large number of entries that an operator at the well site is expected to initiate to achieve the desired result 404.

The instructions 412 may be communicated via e-mail, text, intranet/internet web page, voice message, or other suitable message to an operator 414, such as a reservoir engineer. In a manual process for managing the wellbore equipment, the operator 414 may be given the option to approve, deny or delay the implementation of the proposed instructions 412. If approved by the operator 414, the instructions 412 are entered manually into the well site control unit 146 (FIG. 1) (Block 416) resulting in one or more altered settings for the wellbore equipment. Manual entry of instructions at the well site can be time consuming and result in errors. Accordingly, the system 400 may be configured to execute the instructions automatically. In one embodiment, with an automated process, the control unit 410 may be configured to send such instructions (Block 418) to the well site controller (146 of FIG. 1). The controller 146 may receive the instructions and apply new equipment settings automatically (Block 420). After applying the new equipment settings (step 416 or 420), the instructions and equipment settings are communicated via feedback loop 422 to the control unit 410. The control unit also may be provided with the measured values after the new setting to update the system programs and information 414.

In another aspect, the analysis unit 410 may be configured to generate a script file (also referred to herein as "macro" or "macro file") 424. In one aspect, a script file may include all proposed setting that may be implemented by an operator using a single command or automatically by the well site control unit. In another aspect, a script file may include a sequence of commands, which may be timed, where delays may be implemented between commands. As depicted, the script file may be submitted to the operator 414 for review and approval. In another aspect, the script file may be a set of instructions and settings that enable the operator to review the sequence of commands and implement the script with a simple start command. Further, the operator may be restricted from editing the script file, thereby preventing implementation errors. The operator, however, may be given the option to approve, deny or delay the implementation of the script file. In another aspect, the script file generated at Block 424 may be sent to the well site controller 418 to execute the script file automatically. Such a method is useful when well site personnel are not available to review the instructions or the well site personnel may lack the expertise to review and implement the instructions, which is often the case in remotely located well sites. In other aspects, the controller may generate a plurality of script files from the model and operator input, wherein each of the script files may correspond to a particular time or condition at the rig site. In such a case, the rig site personnel may select the appropriate script file for the conditions and time.

Figure 5:
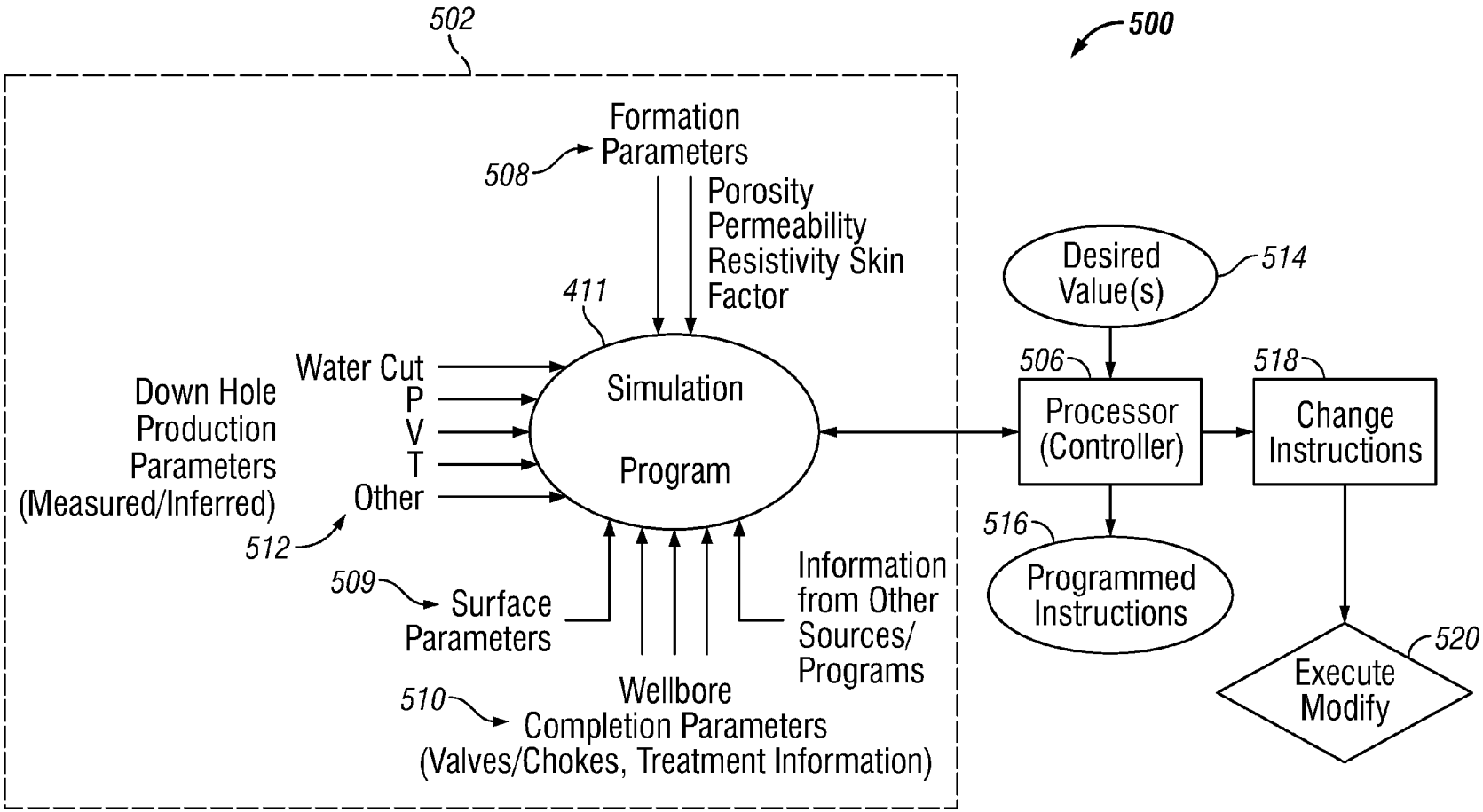
FIG. 5 is a schematic block diagram of components of a wellbore monitoring and control system, according to one embodiment.

FIG. 5 is a schematic diagram of a wellbore monitoring and control system 500. The system 500, in aspects, may include a simulation software or model 411, which may include one or more models composed of one or more simulation and analysis programs which may include commands, code, functions, and algorithms embedded in one or more computer-readable media accessible to one or more computer processors 506 that executes instructions contained in the programs 516 perform the methods described herein. The program 411 may utilize inputs from a variety of sources, including, but not limited to, formation parameters 508, wellbore completion parameters 510, downhole production parameters 512, surface parameters 509, and information from other sources and programs 513. The formation parameters 508 may include, but are not limited to, porosity, permeability, resistivity and skin factor. Well completion parameters 510 may include, but are not limited to, information about the various flow and other devices in the well (such as available settings for each device and current settings of such devices) and chemical treatment information. Downhole production parameters 512, acquired from wellbore sensors, by calculation or from another sources, may include, but are not limited to, water cut, pressure, flow rate (volume or mass), temperature, corrosion, asphaltene, composition of production fluid and other parameters.

In aspects, the processor 506 may utilize the inputs, including the settings, to update the simulation program. As previously discussed with reference to FIG. 4, an operator may graphically input the desired values or changes, as shown by input 514. In one exemplary embodiment, the simulation and analysis program 504 may be stored in any suitable machine readable medium. The processor 514 also has access to programmed instructions 516, which may include operating systems, other application programs and hardware/firmware management services. The programmed instructions 516 manage system resources, including memory and processors, and may enable communication of data, inputs, and commands between the user inputs 514, programs 411), memory and programs 516. The processor 506 may utilize programs or algorithms, including the simulation and analysis program 411 to process the desired values 514 and generate the instructions 518 to achieve the desired values 514. The instructions 518 may be communicated to an operator for approval and implementation 520 or may be executed directly by a rig site controller in an automated system. Further, if the operator is given permission to edit the instructions, the operator may modify the instructions as shown by block 520.

In one aspect, the programs 411 may be in the form of a well performance analyzer (WPA), which is a program that is used by the processor 506 to analyze some or all of the formation parameters 508, wellbore completion parameters 510, downhole production parameters 512, desired values from an operator 514, logged information in a database, and any other desired information made available to the processor 506 to determine the set of instructions to be applied, monitor the effects of the actions taken and perform an analysis. The well performance analyzer may use a forward looking model that may be utilize a nodal analysis, a neural network, an iterative process or another algorithm to generate the instructions. The controller 506 may update such models based on the measured data and results of the implemented instructions.

The well performance analyzer may utilize current measurements of pressure, flow rates, temperature, historical, laboratory or other synthetic data to establish a model of the wellbore and the wellbore equipment. The models may utilize or take into account any number of factors, such as the: amount or percent of pressure in the wellbore that is above the formation pressure and the length of time for which such a pressure condition has been present; rate of change of the pressures; actual pressure values; difference between the pressures; actual temperatures of the upper and lower production zones; difference in the temperatures between the upper and lower production zones; annulus (upper zone) being greater than the pressure in the tubing (lower zone) while the lower zone is open for producing fluids; flow measurements from each of the production zones; a fluid flow downhole approaching a cross flow condition; and other desired factors. The programs may also generate inferred parameters, which may be calculated based on related actual measurements, logged data, and algorithms. For example, referring to the system of FIG. 2, a sensor 206 may include a temperature and flow rate sensor, to save system costs. Accordingly, a system controller may calculate other parameters, such as temperature, based on these measurements. Another example may be a water production parameter that is calculated based on other inputs. The water production parameter may be another input to the programs 411, wherein the calculated water production parameter is a curve used to predict water flow into the well. The water production curve may be an input that helps prevent excessive water inflow ("water breakthrough"), which can be detrimental to the operation of the well. The system 500 may use the water production parameter to configure instructions that prevent unwanted water inflow for the well.

Figure 6:
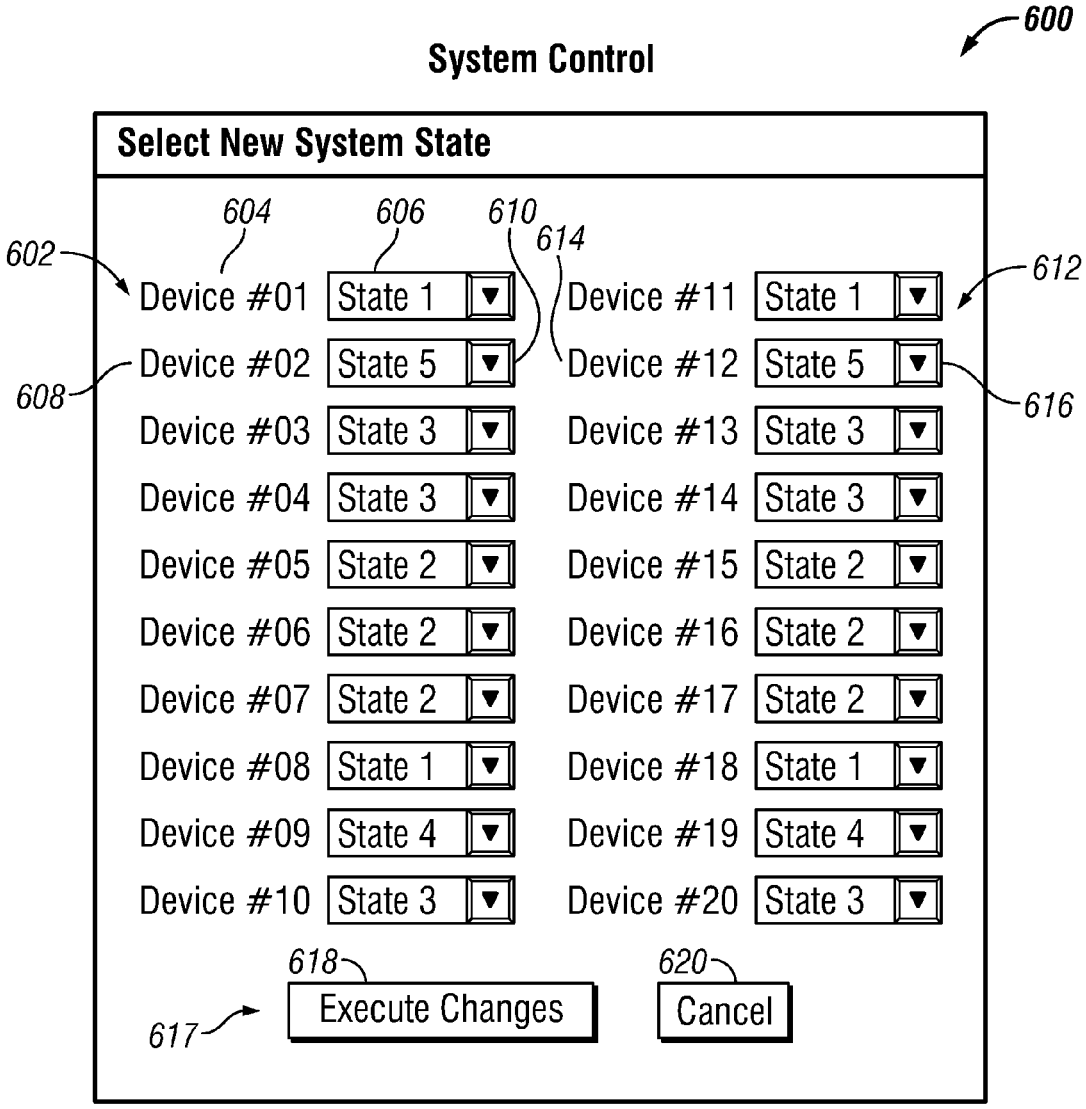
FIG. 6 is a diagram of a user interface showing available control devices and their settings in a wellbore, according to one embodiment.

FIG. 6 is an illustration of a user interface 600 that may be used to manually control one or more wellbore devices. The user interface 600 may be a part of a computer program that utilizes hardware and software to communicate information with and to control wellbore devices, such as valves, chokes, sliding sleeves, and fluid injection devices. An operator may operate the user interface 600 to view and manually configure settings for a plurality of devices in a wellbore. In an aspect, a first set of controls 602 and a second set of controls 612 may be used to individually set a state for each device. A device label (604, 608, 614) and status selector (606, 610, 616) correspond to the wellbore device and state for each device, respectively.

The operator may use the user interface 600 to a view a current state for each device, which may be displayed by the selector (606, 610, 616). Referring also to FIG. 4, the operator (414) may receive instructions (412) to change the device settings by selecting a state (606, 610, 616) for each device, wherein the user interface 600 (FIG. 6) runs on a computer (416) to apply the desired changes in the settings. Referring to FIG. 6, in an aspect, label 604 enables an operator to select "State 1" (606) for "Device 1." Further, a label 608 enables an operator to select "State 5" (610) for "Device 2." The selectors 606 and 610 enable different state choices for an operator, depending on the device the label corresponds to. For example, a sliding sleeve may provide more state choices for the corresponding selector (606, 610, 616) than a traditional valve would. As depicted, the operator may select one of five states (1-5) that correspond to a particular setting for each device. In an aspect, the "State 1" selector status may correspond to any suitable operating state for each device, such as open, choked, or closed.

The user interface 600 may also have a set of operation buttons 617. The operation buttons 617 may enable a user to perform actions pertaining the plurality of equipment settings selected in control sets 602 and 612. For instance, the operator may select to execute the setting changes by pressing or selecting an execute button 618. Alternatively, the operator may cancel the proposed setting changes by selecting a cancel button 620. In another embodiment, various other buttons, such as delay or review, may be included in operation buttons (617). In addition, more controls and corresponding labels may be included to enable additional modifications by the operator to the equipment settings. In the manual operation of FIG. 6, when an operator implements a set of settings for a desired task, such as production from only a selected zone, the number of settings and number of devices may lead to operator errors. In addition, specific tasks may include instructions incorporating delays between implementing various device settings, further complicating the process and increases incidence of error. The user interface 600 may require a plurality of individual settings for each device for a simple task, such as maintenance. Accordingly, the operator may spend a significant amount of time performing the input changes for the task.

Figure 7:
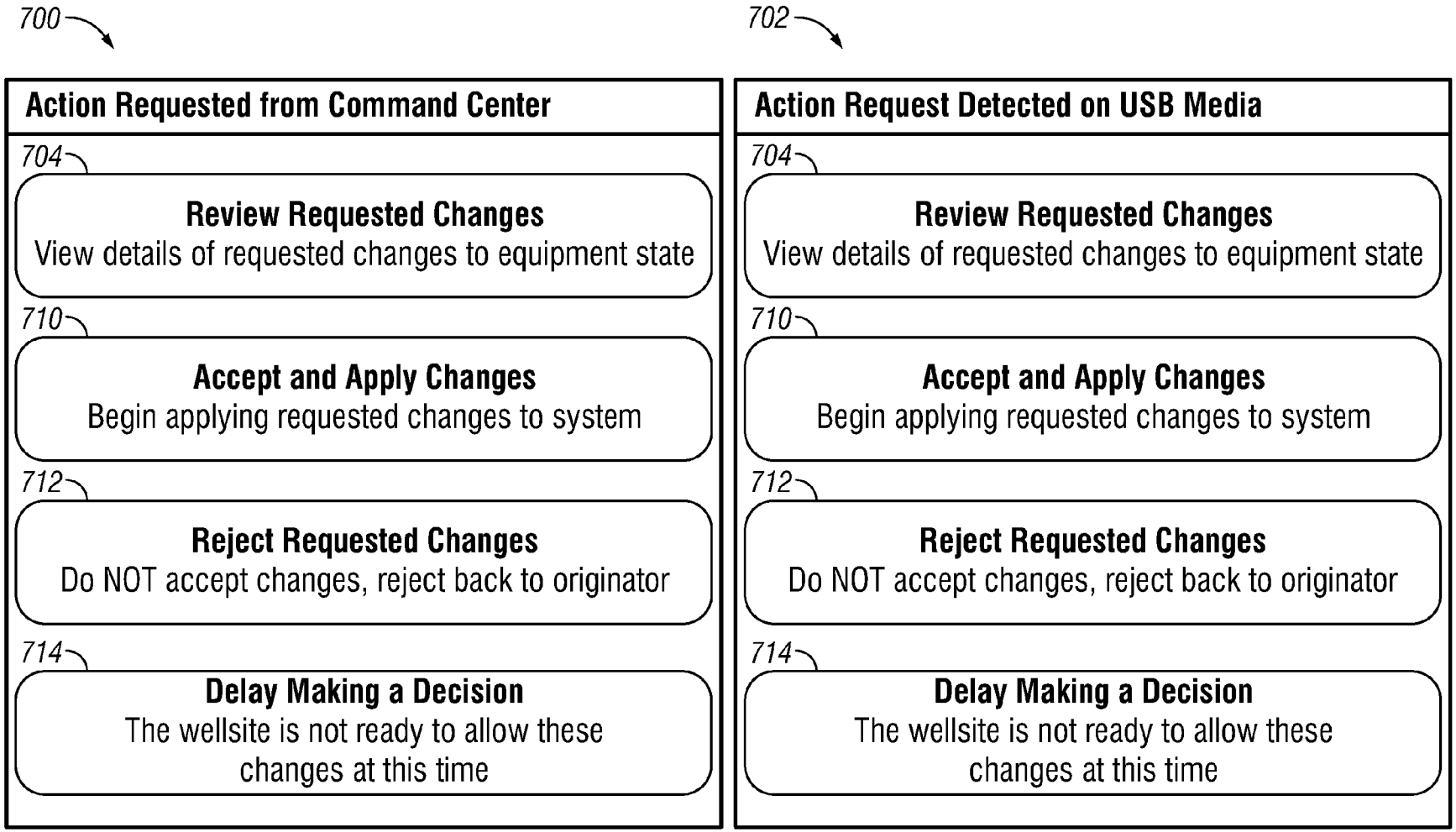
FIG. 7 is a diagram of a user interface of a program to control production equipment using a script communicated from a remote location to a wellsite, according to one embodiment.

FIG. 7 is a diagram of user interfaces 700 and 702 of a program which enables an operator or automated program at a remote location to transmit a script or macro to a well site operator. The script may be a file generated by a software program. The script may include a list and/or sequence of settings, commands, and other instructions for the wellbore equipment. The user interface 702 enables the rig site operator to receive the script file transmitted from a portable memory device, such as a universal serial bus (USB) device. In an aspect, a remotely-located engineer may use a software program, a wellbore model, and an associated computer to generate the script file which, when implemented, will provide a desired level for one or more parameters relating to the wellbore production. The user interface 700 enables the operator to receive the script file from a remote central office, via a network transmission, radio signal, or other suitable communication method. An operator may use interface 700 to view or apply a script file that has been emailed or placed on a network drive that is accessible to the well site and remote office. A controller computer may be configured to detect that a script file has been received from the USB device or via the network. The controller may then provide the operator with the appropriate interface and options. For the purposes of this embodiment, each of the interfaces includes the same command buttons. In other embodiments, the controller may provide different options for an operator based on the source of the script or other inputs.

As depicted, the user interfaces 700, 702 include a plurality of operation buttons 706 to locally control implementation of the script. The operation buttons may include a review changes button 704, accept button 710, reject button 712, delay button 714, and cancel button 716. The operator may review the settings and instructions in the script file by selecting the review changes button 704. The operator may initiate the instructions in the script file by selecting the accept button 710 and may reject the proposed changes by selecting reject 712. In addition, the operator may select delay 714 if maintenance needs to be finished or the operator has questions for the remote office before applying the proposed changes. In an aspect, the script file and user interface 700, 702 restrict the operator's options after presentation of the script file from the remote office, thereby reducing errors from implementation and communication of the instructions. For example, the operator may be restricted from editing the script file and may only be presented with the review (704), accept (710), reject (712), and delay (714) options, as illustrated.

Figure 8:
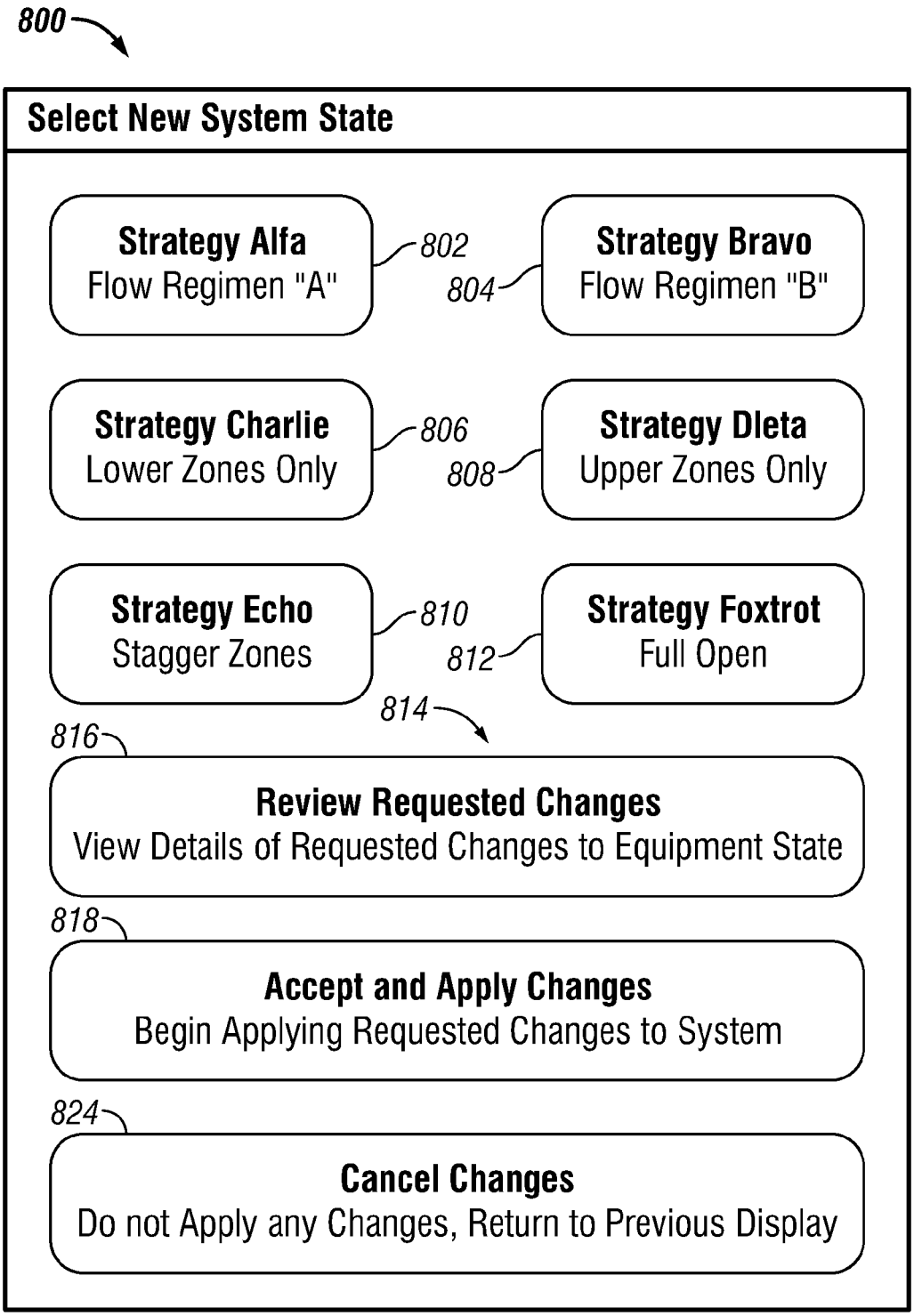
FIG. 8 is a diagram of a user interface of a program to control production equipment using a plurality of pre-configured scripts, according to one embodiment.

FIG. 8 is an illustration of a user interface 800 that enables an operator to select from a plurality of pre-configured scripts that correspond to a system state. In one aspect, the pre-configured scripts may be pre-loaded onto a rig site controller before the controller is installed at a remotely located rig site, wherein the plurality of scripts are customized to control the wellbore equipment included at the site. The pre-configured scripts may be utilized in situations in which personnel and communication devices at the rig site cannot reliably or consistently communicate with remote central offices. The rig site's remote location may prevent transmission of a script via network or USB, as discussed with reference to FIG. 7. In these situations, a set of pre-configured scripts tailored to the application and wellbore equipment may be used to prevent production errors at the rig site.

The user interface 800 includes buttons corresponding to a plurality of scripts, including scripts for Alfa 802, Bravo 804, Charlie 806, Delta 808, Echo 810, and Foxtrot 812 strategies. The operator may base selection of a pre-configured script based on certain situations and/or time schedules. For example, an operator may select the script for "Strategy Alfa" 802 based on surface measurements of production fluid, including water cut and other fluid composition information. Further, the operator may select the script for "Strategy Bravo" 804 based on a pre-determined timeline, wherein the script is configured to be executed six months after wellbore production begins. In addition, the scripts may also be configured to perform a test or maintenance routine for the wellbore equipment. In an aspect, the scripts may also correspond to strategies for production from only selected zones in the wellbore, such as lower zones (806) or upper zones (808). The user interface 800 may also include a plurality of operation buttons 814, including a review changes button 816, accept button 818, and cancel button 824. As discussed above, the operation buttons enable an operator to review the script contents, accept the script, reject the script, delay implementation, or cancel the user interface.

As described herein, the scripts (or macros) include a series or sequence of settings and commands to control wellbore equipment. The wellbore equipment settings may be complex. The scripts discussed above prevent errors that may otherwise occur during implementation and communication of the settings and commands. In addition, the scripts enable a skilled off-site engineer to generate a list of commands, enabling the rig-site operator to concentrate on maintenance and operational tasks. The incidence of errors is also reduced by preventing operators from editing the scripts developed by experienced engineers. The scripts may be configured to perform various operations and functions, including tests, maintenance, and production from selected zones in the wellbore. The scripts are a series of instructions in a declarative format that contain metadata to allow a program to verify the authenticity of the generator of the script. The processor used to generate the script and/or instruction file may be located at the wellsite or at a centralized location remote from the wellsite. In an aspect, the script may be developed and executed on a controller or computer that includes a processor, memory, other programs, operating systems, and hardware/firmware management services. For example, the rig site controller 146 of FIG. 1 may be used to run the user interfaces and scripts discussed in FIGS. 6-8.

Thus, in general, the system described herein may display all relevant equipment or device information overlaid with depth-based and/or time-based graphical visualization of static and/or dynamic data regarding the well and related equipment. The user may choose to enable or disable any information overlays. The user may select one or more metrics of the well operation and performance such as measures of the sensor and depth-based or time-based trends and alter by manipulating the graphic display of those metrics (such as by dragging up or down) to desired performance or operating levels. Depending on the well conditions or the algorithm used, the software can perform several functions, including, but not limited to: (i) analyze and compute the optional optimal equipment settings to achieve as close to the desired result as possible, (ii) cycle through permutations of valid equipment settings to provide settings that will most likely achieve the desired results; and use a genetic, evolutionary or forward looking algorithm or model to perform an iterative sequence of permutations of equipment settings to provide settings most likely to achieve the desired results, in view of the result of the previous configurations.

While the foregoing disclosure is directed to the certain exemplary embodiments and methods, various modifications will be apparent to those skilled in the art. It is intended that all modifications within the scope of the appended claims be embraced by the foregoing disclosure.

What is claimed is:

1. A method for controlling formation fluid flow into a production wellbore containing a plurality of production devices, comprising:

defining a first setting of each production device in the plurality of production devices, wherein the first setting of a selected production device determines a first flow rate of formation fluid flowing from a formation into a production tubular in the wellbore, the formation fluid comprising at least one of oil and gas;

displaying, at a user interface, a first chart showing a status indicator representing the plurality of production devices over a length of the production wellbore and indicating their status, the first chart further showing measurements of a parameter related to the first flow rate of formation fluid obtained at the plurality of production devices at a selected time;

displaying, at the user interface, a second chart showing the measurements of the parameter over time at a selected position;

graphically manipulating the measurements of the parameter in the first chart to indicate a desired flow rate at a selected depth;

using a model to determine a second setting for at least one of the plurality of production devices based on the desired flow rate at the selected depth;

generating a script corresponding to the second setting;

submitting the script to an operator for approval; and implementing the script without modification upon approval of the operator.

2. The method of claim 1, wherein using the model to determine the second setting comprises determining a sequence of settings for the plurality of production devices.

3. The method of claim 1 further comprising transmitting the script to a controller for implementing the script.

4. The method of claim 1, wherein the production devices are selected from the group consisting of: valves, chokes, and chemical treatment devices.

5. The method of claim 1 further comprising providing the script to the operator via one of: a portable memory device; and via a communication network.

6. The method of claim 1 further comprising providing the script to the operator via a communication network.

7. The method of claim 6, wherein providing the script includes providing options to: run the script; reject the script; and delay use of the script.

8. A method for controlling wellbore devices in a wellbore for production of formation fluid, comprising:

measuring values of at least one production parameter at a plurality of production device over a length of the production wellbore, the production parameter relating to production of formation fluid comprising at least one of oil and gas from a formation into a production tubular at a selected depth;

displaying, at a user interface, a first chart showing a status indicator representing the plurality of production devices over a length of the production wellbore and indicating their status, the first chart further showing the measured values obtained at the plurality of production devices at a selected time;

displaying, at the user interface, a second chart showing the measured values over time at a selected position;

graphically manipulating the measurements in the first chart to indicate a desired value for the at least one production parameter at a selected location;

processing the desired value to determine a setting of at least one production device which provides the desired value when implemented, wherein the at least one production device comprises a production device that is controlled to regulate a flow of a formation fluid;

creating a script file corresponding to the setting;

submitting the script file to an operator for approval; and implementing the script file without modification to change a setting of the at least one production device upon approval of the operator.

9. The method of claim 8, wherein processing the desired value comprises using a model to determine the setting of at least one production device.

10. The method of claim 8, comprising generating a display of a wellbore layout and a first value for the at least one production parameter corresponding to the wellbore layout.

11. The method of claim 8, comprising providing the script to the operator, wherein the operator cannot modify the script.

12. The method of claim 11, wherein providing the script to the operator comprises transmitting the script via a communication network.

13. The method of claim 11, wherein providing the script to the operator comprises transmitting the script via a portable memory device.

14. The method of claim 8, wherein the at least one production device is selected from the following group: valves, chokes, and chemical treatment devices.

15. A method for controlling flow of formation fluid into a production wellbore, comprising:

measuring values of at least one production parameter at a plurality of production device over a length of the production wellbore, the production parameter relating to production of formation fluid comprising at least one of oil and gas from a formation into a production tubular at a selected depth;

displaying, at a user interface, a first chart showing along an axis a status indicator representing the plurality of production devices over a length of the production wellbore and indicating their status, the first chart further showing along the axis the measured values obtained at the plurality of production devices at a selected time;

displaying, at the user interface, a second chart showing the measured values over time at a selected position;

graphically manipulating the measurements in the first chart to indicate a desired value for the at least one production parameter at a selected location;

using a model to generate a sequence of settings for at least one production device in the wellbore, wherein the sequence of settings corresponds to the desired value for the at least one production parameter;

generating a script that includes the sequence of settings;

providing the script to an operator, wherein the operator cannot modify the script and the script is configured to run by receiving a command from the operator; and implementing the script without modification to change a setting of the at least one production device upon receiving the command from the operator, wherein the at least one production device comprises a production device that is controlled to regulate a flow of a formation fluid from a formation into the production tubular.

16. The method of claim 15, comprising generating a display of a wellbore layout and a first value for at least one production parameter corresponding to the wellbore layout, wherein the model uses the desired value to determine the sequence of settings.

17. The method of claim 16, wherein the wellbore layout includes a status indicator to display current settings of the one or more production devices.

18. The method of claim 15, wherein providing the script to the operator comprises transmitting the script via a portable memory device.

19. The method of claim 15, wherein providing the script to the operator comprises transmitting the script via a communication network.

20. The method of claim 15, wherein the one or more production devices are selected from the following group: valves, chokes, and chemical treatment devices.

* * * * *